United States Patent [19]

Sengewald

[11] Patent Number: 4,696,050

[45] Date of Patent: Sep. 22, 1987

[54] PACKAGE FORMED AS BAG TO BE CARRIED

[76] Inventor: Karl-Heinz Sengewald, Postfach 1460, 4802 Halle in Westf. 1, Fed. Rep. of Germany

[21] Appl. No.: 783,759

[22] Filed: Oct. 3, 1985

[30] Foreign Application Priority Data

Oct. 20, 1984 [DE] Fed. Rep. of Germany ..... 3438601

[51] Int. Cl.[4] ..... B65D 33/62; B65D 33/08

[52] U.S. Cl. ..... 383/10; 383/21; 383/106; 493/200; 493/222; 493/223

[58] Field of Search ..... 383/9, 10, 21, 106; 493/222, 199, 200, 223

[56] References Cited

U.S. PATENT DOCUMENTS

| | | | |
|---|---|---|---|
| 1,419,739 | 6/1922 | Kniep | 383/10 |
| 3,101,887 | 8/1963 | Kugler | 383/9 |
| 3,206,105 | 9/1965 | Smith | 383/10 |
| 3,235,168 | 2/1966 | Nichols | 383/9 |
| 3,249,285 | 5/1966 | Dollheimer et al. | 383/9 |
| 3,720,141 | 3/1973 | Stock | 383/10 |
| 4,252,269 | 2/1981 | Peppiatt | 383/10 |
| 4,456,122 | 6/1984 | Kalal | 383/106 |
| 4,509,197 | 4/1985 | Long | 383/106 |
| 4,610,029 | 9/1986 | Huhtala et al. | 383/10 |

FOREIGN PATENT DOCUMENTS

| | | | |
|---|---|---|---|
| 3102192 | 9/1982 | Fed. Rep. of Germany | 383/10 |

*Primary Examiner*—Stephen P. Garbe
*Attorney, Agent, or Firm*—Michael J. Striker

[57] ABSTRACT

A package which is formed as a bag to be caried has a plurality of lateral walls having upper portions which form a gripping part and lower portions which form a body part, two first opposite walls are folded, two second opposite walls are provided in the region of the gripping part with a gripping opening and upper and lower welding seams which connect the walls with one another and separate the gripping part from the body part, one of the second opposite walls has a section adjoining the gripping part and is provided with window-like opening, and a covering foil covers the window-like opening of the section of one opposite wall.

12 Claims, 8 Drawing Figures

PACKAGE FORMED AS BAG TO BE CARRIED

BACKGROUND OF THE INVENTION

The present invention relates to a package which is formed as a bag to be carried.

More particularly, it relates to such a package which has a plurality of lateral walls with lower portions which form a body part, upper portions which form a gripping part, wherein the lateral walls have two first opposite walls which are folded and two second opposite walls with gripping opening in its upper portions, and wherein welding seams extend over the width of the package above and below the gripping opening and connect the lateral walls with one another and also separate the gripping part from the body part.

Packages of the above-mentioned general type are known in the art. One of such packages is disclosed, for example in the DE-OS No. 3,102,192. Such packages are used for purchasing and storing of diapers. The disadvantage of this package is that for removing of individual diapers, the package must be cut off or torn off.

SUMMARY OF THE INVENTION

Accordingly, it is an object of the present invention to provide a package of the above-mentioned general type, which is formed so that removal of individual packages is facilitated and simultaneously the gripping region of the package is reinforced.

In keeping with these objects and with others which will become apparent hereinafter, one feature of the present invention resides, briefly stated, in a package which has a plurality of walls with lower portions forming a main part, an upper portion forming a gripping part provided with a gripping opening, wherein in accordance with the present invention one side wall has a section which adjoins the gripping part and is provided with a window-like opening, and a covering foil easily removably covers the window-like opening.

When the package is designed in accordance with the present invention it enables a simple removal of packed objects since the covering foil can be easily removed or opened. Simultaneously, the window-like opening does not lead to any weakening of the package and its carrying ability, since the covering foil provides a sufficient reinforcement. The inventive construction has also the advantage that the covering foil can be transparent or translucent so as to enable a user to see the contents of the package.

In accordance with another embodiment of the invention, the covering foil which covers the window-like opening extends over the gripping part and is connected with the gripping part as well as provided with a further gripping opening associated with the gripping openings of the upper portions of the second opposite walls. As a result of this, the covering foil additionally reinforces the gripping part, so that despite the provision of the window-like opening, an increase in the carrying capacity of the package is obtained.

The window-like opening advantageously has a rectangular contour. It can have such a spatial form that it is oval-like. The covering foil mainly has a rectangular contour.

In the region of the window-like opening, the covering foil can be glued to the lateral wall of the package. The glueing makes mounting of the foil very simple.

Also, the glued covering foil can be easily removed from the region of the window-like opening.

In many cases it is advantageous when the covering foil is welded with the lateral wall, and particularly around the window-like opening. The welding is especially advantageous in connection with the above-mentioned welding seams which are provided above and below the gripping opening and extend over the width of the package or a web of which it is composed.

Welding of the covering foil in the region of the window-like opening is especially advantageous when the covering foil can be peeled from the wall which carries it.

For providing this peeling, it is further proposed in accordance with the present invention to form a welding seam which connects the covering foil with the edge of the window-like opening so that the welding seam extends parallel to an edge of the covering foil and is spaced from the edge so as to form a gripping strip. Since in the filled package this gripping strip can be easily engaged by hand by means of a thumb and index finger, the separation of the covering foil from the wall of the package can be performed very simply.

In accordance with a further feature of the present invention, the covering foil is provided with tearing off perforations which correspond to the contour of the window-like opening. Thereby application of pressure for example by a thumb against the covering foil leads to tearing of the perforations at the local points, and then the covering strip is engaged between the thumb and the index finger and separated along the perforations so that the interior of a package becomes easily accessible.

In accordance with the present invention, a new method of manufacturing the above-described package is provided. In this method of manufacturing a window-like opening is punched out in a flat web or in a semi-hose, then this window-like opening is covered by a covering foil connected to the hose wall and having a length which is double length of the window-like opening, then the semi-hose is provided with lateral folds and enclosed by a longitudinal welding seam to form a hose, and after this, a gripping opening is formed through the covering foil and both hose walls simultaneously with the position of both transverse welding seams at both sides of the gripping opening.

With this inventive solution it is possible to form in a simple manner a package in which its gripping region is closed from its filling region in shape-rigid and thereby carrying-advantageous manner, and at the same time easy accessibility to the interior of the package is possible.

A simple observation of the interior of the package can be provided by applying such a foil which is light permeable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
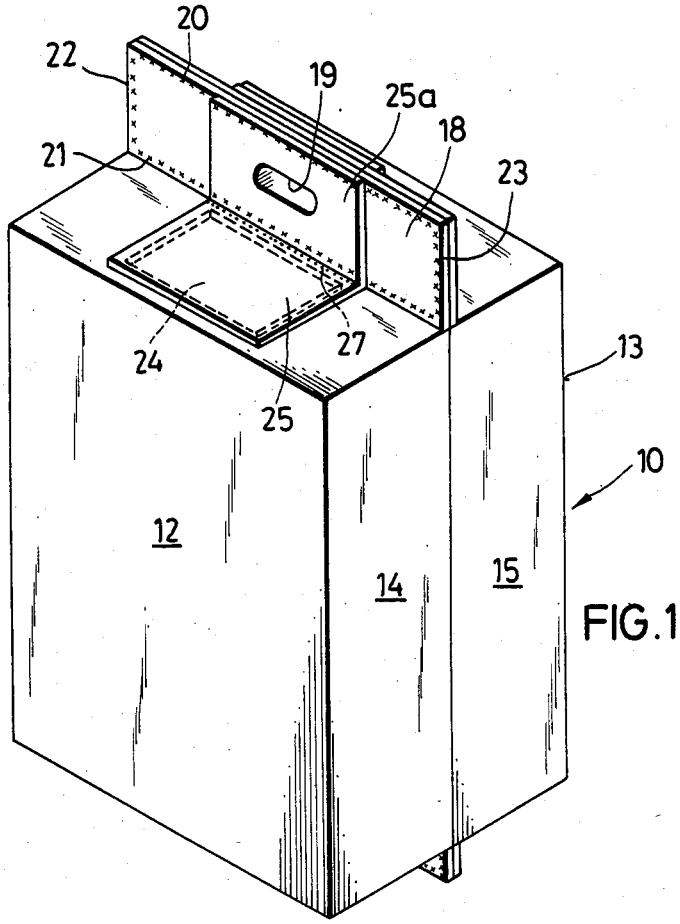
FIG. 1 is a perspective view of a package which is formed as a bag to be carried, in accordance with the present invention.

A package formed as a bag to be carried is identified with reference numeral 10 as a whole. It is composed of a thermoplastic synthetic foil and formed of a flat web 11 of thermoplastic synthetic foil. The package has a front wall 12, a rear wall 13 and side folds 14 and 15 at one side as well as side folds 16 and 17 at the other side, as can be seen from FIG. 7.

The package has a gripping region 18 with a punched out gripping opening 19. Welding seams 20 and 21 are provided above and below the gripping opening. They connect both walls 12 and 13, and also lateral folds 14, 15 at one side and lateral folds 16, 17 at the other side. Welding seams 22 and 23 can be provided on outer edges of the gripping region and extend in longitudinal direction of the package of the initial hose. They also connect both outer foil layers with the connected lateral folds.

A window-like opening in the wall 12 is identified with reference numeral 24. The opening 24 is covered by a covering foil 25. The covering foil is arranged not only in the region of the above-mentioned rectangular opening and overlaps the same so as to provide connection of the cover foil with the wall 12, but the covering foil 25 also extends to the gripping region 18. More particularly, it extends in the gripping region 18 in such a manner that it passes the gripping opening 19 and simultaneously an extended region 25*a* of the covering foil is connected by the above-mentioned transverse welding seams 20 and 21 with the gripping region, so as to provide reinforcement of the gripping region. The covering foil takes over the function of providing the strength in the head part of the package, which is reduced by the window-like opening 24.

FIG. 1 shows that the covering foil is glued to the wall 12. Both above-mentioned transverse welding seams 20 and 21 are used in addition to the glueing.

For opening the window, the covering foil is released from the wall 12. For this purpose it can be provided by a non-adhesive area 32. For retaining the extended region 25*a* on the gripping region, perforations 27 can be provided at a small distance parallel to the welding seam 21. Also it is possible to provide a perforation 27 which forms a rectangle so as to reach the opening in the package by pressing and tearing of the covering foil along the perforation line.

Figure 2:
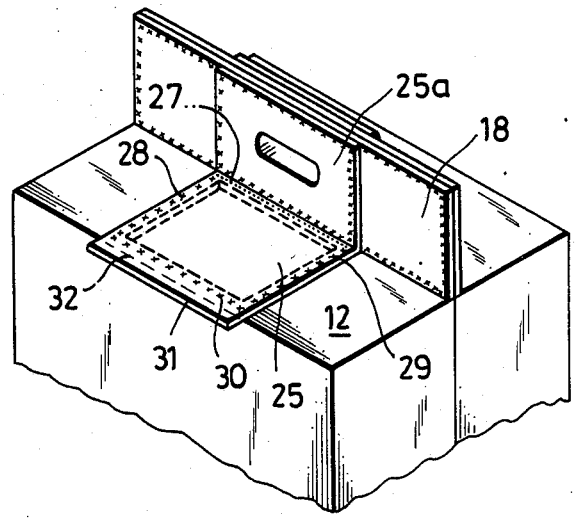
FIG. 2 is a view showing a package substantially corresponding to the package of FIG. 1, but provided with a different covering foil for a window-like opening.

FIG. 2 shows another embodiment in accordance with which the covering foil 25 with the extended portion 25*a* for reinforcing the gripping region 18 of the wall 12 is connected to the package by two welding seams 28 and 29 which extend in the longitudinal direction of the initial hose and are spaced at a small distance relative to the edges of the covering foil. A further transverse welding seam 30 is provided which has a greater distance to the transversely extending front edge 31 of the covering foil, so that it forms a gripping strip 32 which is easily engageable by hand. Thereby the foil or strip which covers the window and in some cases is provided with perforation line 27, can be easily removed from the wall 12 by detaching.

FIGS. 1 and 2 show that the covering foil or strip 25 with the extended portion 25*a* in the gripping region 18 is provided at each side of the package. In many cases it is however possible to provide it only at one side.

Figure 4:
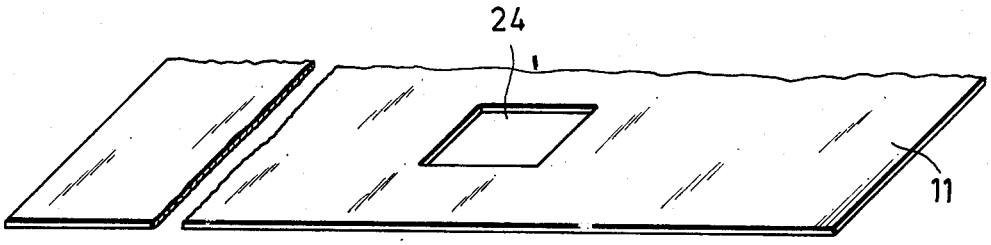
FIGS. 4–8 are views showing the steps of manufacturing of the package in accordance with the present invention.
Figure 5:
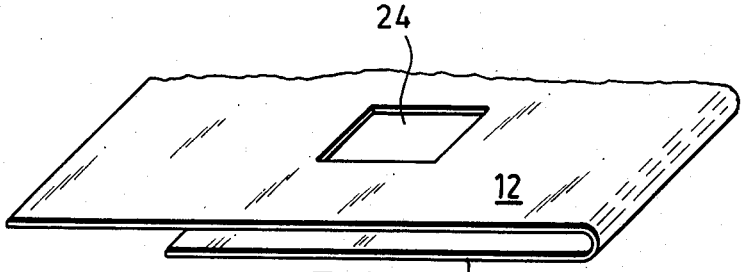

FIG. 4 shows that for manufacturing the package the flat web 11 is used. The window-like openings 24 are punched out on this flat web or in a semi-hose formed from the flat web and shown in FIG. 5.

Figure 6:
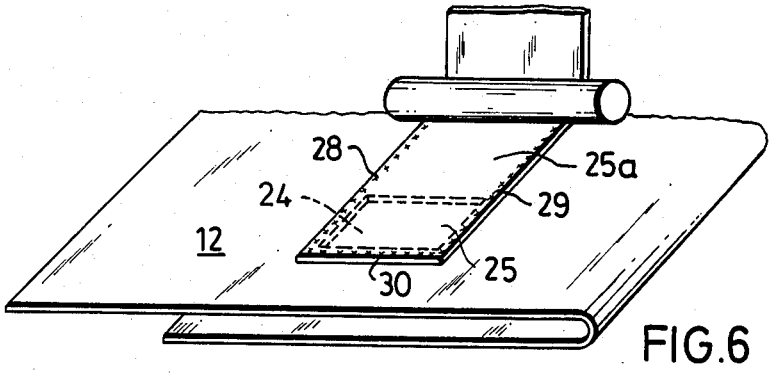
Figure 7:
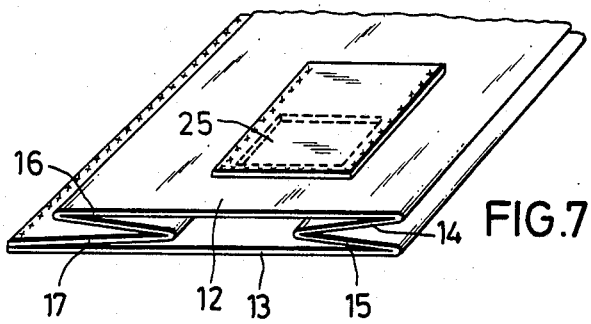

FIG. 6 shows that the covering foil 25 with the extended portion 25*a* is applied to the semi-hose and connected with the foil portion corresponding to the wall 12 by two longitudinal welding seams 28 and 29 and a transverse welding seam 30. The lateral folds 14, 15 at one side, and the lateral folds 16, 17 at the opposite side are then formed as shown in FIG. 7.

Figure 8:
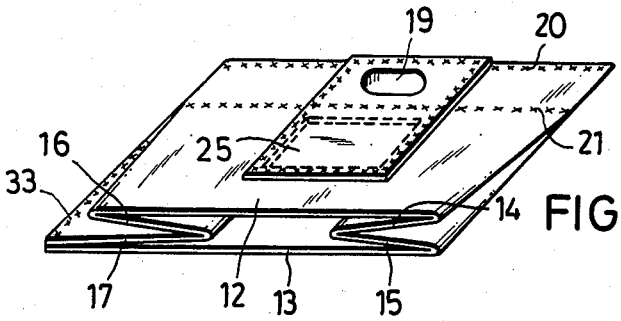

FIG. 8 illustrates the formation of a longitudinal welding seam 33 for forming the hose, and the production of the gripping opening 19 as well as the transverse welding seams 20 and 21, arranged at both sides.

Figure 3:
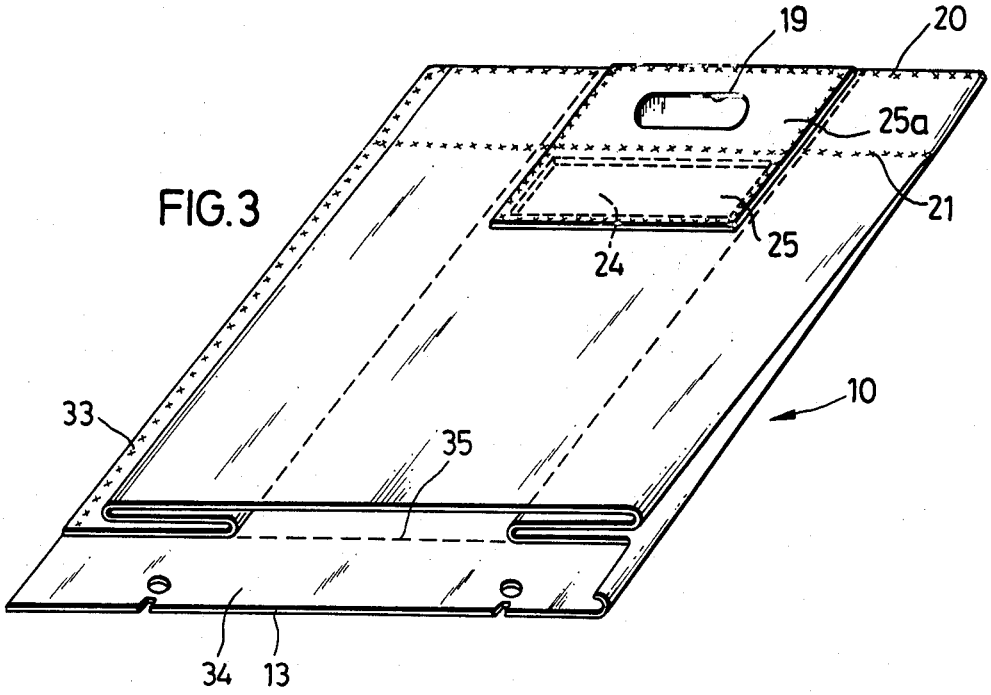
FIG. 3 is a view showing the package of FIG. 1 in flattened, non-filled condition.

As can be seen from FIG. 3 the package which lies flatly and is not yet filled is provided with an upper flap 34 which is separable from the package by means of a tearing perforation 35 and serves for easy filling.

It will be undertood that each of the elements described above, or two or more together, may also find a useful application in other types of constructions differing from the types described above.

While the invention has been illustrated and described as embodied in a package formed as a beg to be carired, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A package formed as a bag to be carried, comprising a plurality of lateral walls having upper wall portions and lower wall portions, said lateral walls including two first opposite walls which form folds and two second opposite walls; a body part formed by said lower portions of said lateral walls; a gripping part including said upper portions of said second opposite walls, a gripping opening provided in each of said upper portions of said second opposite walls, and welding seams provided above and below said gripping opening so as to connect said first opposite walls and said second opposite walls with one another and also to separate said gripping part from said body part, one of said second opposite walls having a section which adjoins said gripping part and is provided with a window-like opening; and a covering foil which easily detachably covers said window-like opening.

2. A package as defined in claim 1, wherein said covering foil has a main section which covers said window-like opening and an extension section which extends toward said gripping part and is connected with said gripping part and is provided with a further gripping opening associated with said first mentioned gripping openings in said upper portions of said second opposite walls.

3. A package as defined in claim 1, wherein said window-like opening has a rectangular contour.

4. A package as defined in claim 1, wherein said covering foil is glued to said one second opposite wall.

5. A package as defined in claim 1, wherein said covering foil is welded with said one second opposite wall.

6. A package as defined in claim 5, wherein said section of said one opposite wall includes an edge of said window-like opening, said covering foil being connected with said edge by a welding seam extending transverse to said covering foil, said covering foil having an edge which is spaced from said welding seam by such a distance that a manually graspable strip is formed.

7. A package as defined in claim 1, wherein said window-like opening has a predetermined contour, said covering foil being provided with tearing perforations extending over the contour corresponding to the contour of said window-like opening.

8. A package as defined in claim 1, wherein said walls are formed of a thermoplastic synthetic foil.

9. A method of manfacturing a package as formed as a bag to be carried, comprising the steps of providing a pluraltiy of lateral wall having upper portions and lower portions with lower portions forming a body part and upper portions forming a gripping part, and including two first opposite walls and two second opposite walls; folding the first opposite walls; forming in the upper poriton of each second opposite wall a gripping opening; providing above and below the gripping opening welding seams which connect the first opposite walls and the second oppposite walls in the region of the upper portions so as to form the gripping part and which also separate the gripping part from the body part; forming a window-like opening in one of the second opposite walls in its section adjoining the gripping part; and closing the window-like opening in the section by an easily releasable covering foil.

10. A method as defined in claim 9, wherein said step of providing a plurality of lateral walls includes using a flat web as an initial material, said step of forming said window-like opening includes punching out of the window-like opening, said step of covering of the window-like opening with a covering foil includes covering with a covering foil which has a length equal to double length of said window-like opening; and further comprising the step of forming a further gripping opening in said covering foil, said forming of said further gripping opening and said forming of said first-mentioned gripping openings being performed after welding connecting the upper portions of the second opposite walls with one another and weldingly connecting said covering foil with the upper portions of the second opposite walls.

11. A method as defined in claim 9, wherein said step of providing the lateral walls includes using a semi-hose as an initial material, said step of forming said window-like opening including punching out of the window-like opening, said step of covering of the window-like opening with a covering foil including covering with a covering foil which has a length equal to double length of said window-like opening; and further comprising the step of forming a further gripping opening in said covering foil, said forming of said further gripping opening and said forming of said first-mentioned gripping openings being performed after weldingly connecting the upper portions of the second opposite walls with one another and weldingly connecting said covering foil with the upper portions of the second opposite walls.

12. A method as defined in claim 9, wherein said step of providing the lateral walls includes using an initial material; and further comprising the step of forming a longitudinal welding seam to form a hose from the initial material.

* * * * *